United States Patent [19]

Ligtenberg et al.

[11] Patent Number: 4,842,894

[45] Date of Patent: Jun. 27, 1989

[54] METHOD OF VAPOR DEPOSITING A LUMINESCENT LAYER ON THE SCREEN OF AN X-RAY IMAGE INTENSIFIER TUBE

[75] Inventors: Martinus A. C. Ligtenberg; August L. H. Simons, both of Heerlen, Netherlands

[73] Assignee: U.S. Philips Corporation, New York, N.Y.

[21] Appl. No.: 906,476

[22] Filed: Sep. 12, 1986

[30] Foreign Application Priority Data

Sep. 20, 1985 [NL] Netherlands ..... 8502570

[51] Int. Cl.[4] ..... B05D 5/06; B05D 5/12

[52] U.S. Cl. ..... 427/65; 427/69; 427/70; 427/72; 427/248.1; 427/255.5

[58] Field of Search ..... 427/64, 65, 66, 69, 427/70, 72, 248.1, 255.5

[56] References Cited

U.S. PATENT DOCUMENTS

| | | | |
|---|---|---|---|
| 3,652,323 | 3/1972 | Smith | 427/64 |
| 4,035,524 | 7/1977 | Fritsch | 427/72 |
| 4,052,519 | 10/1977 | Prazak | 427/72 |
| 4,069,355 | 1/1978 | Lubowski et al. | 427/70 |
| 4,239,791 | 12/1980 | Sonoda et al. | 427/64 |
| 4,254,160 | 3/1981 | Raih | 427/72 |
| 4,437,011 | 3/1984 | Noji et al. | 250/486.1 |
| 4,528,210 | 7/1985 | Noji et al. | 427/70 |
| 4,529,885 | 7/1985 | Waite et al. | 427/70 |
| 4,687,825 | 8/1987 | Sagou et al. | 427/72 |

*Primary Examiner*—Sadie Childs

*Attorney, Agent, or Firm*—F. Brice Faller

[57] ABSTRACT

Vapor deposition crucible is provided at least twenty degrees from the central normal to a smooth surface of a screen on which luminescent material is to be deposited. During deposition the surface is rotated relative to the source to produce a layer having a regular structure and a good fill factor.

6 Claims, 2 Drawing Sheets

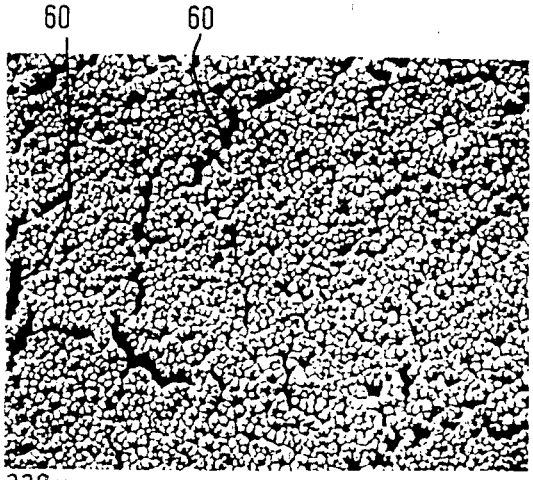
FIG. 3A (1)
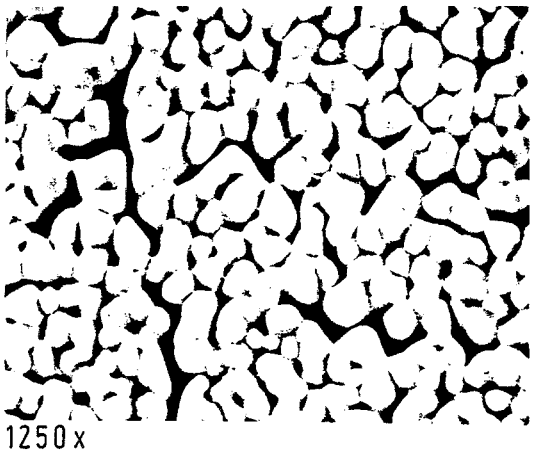
FIG. 3A(2)
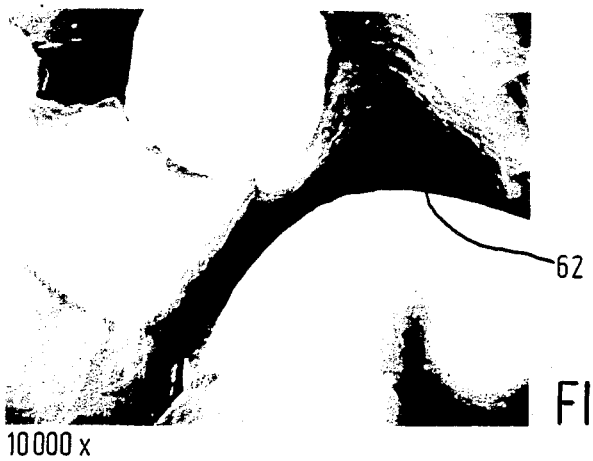
FIG. 3A(3)

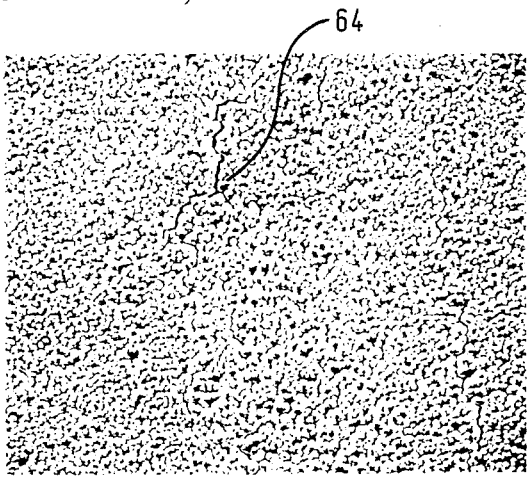
320x
FIG. 3B(1)
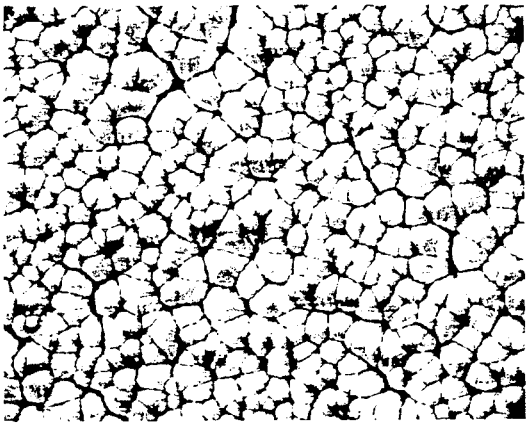
1250x
FIG. 3B(2)
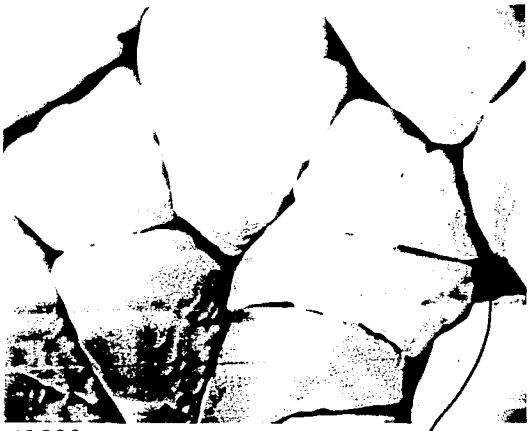
10000
66
FIG. 3B(3)

METHOD OF VAPOR DEPOSITING A LUMINESCENT LAYER ON THE SCREEN OF AN X-RAY IMAGE INTENSIFIER TUBE

BACKGROUND OF THE INVENTION

The invention relates to a method of manufacturing an X-ray image intensifier tube having an entrance screen comprising a layer of luminescent material and a photocathode, which are provided together on a support, and to an X-ray image intensifier tube manufactured by means of this method.

Such a method is known from U.S. Pat. No. 3,821,763. An X-ray image intensifier tube is described therein having a luminescent layer preferably consisting of CsI, in which a structure is formed. On the one hand, a structure is formed in the layer of CsI described therein due to vapourdeposition parameters adapted to this end, such as the temperature of the substrate, the speed of vapour deposition and the like. On the other hand, as described in the aforementioned patent, an additional structure can be formed by a thermal treatment of the layer. A layer having such a structure is known as a layer having a crackled structure. X-ray image intensifier tubes provided with a layer of luminescent material having such a structure have proved satisfactory, but due to the increasingly higher requirements, especially with respect to the resolution of the tube, there is a need of optimizing the structure to this end. In practice, this means that a higher crack frequency in the layer is realized.

SUMMARY OF THE INVENTION

The invention has for its object to satisfy these requirements and for this purpose the layer of luminescent material is deposited on the support at an angle substantially deviating from 0° to a normal to the support.

Due to the fact that the luminescent material is deposited at an angle to the normal to the support, a structure of very fine columns of CsI is obtained extending through the layer and having a cross-section of a few microns to a few tens of microns and having a crack frequency lying between 10.000 lines/cm for 1 μm and 200 lines/cm for 50 μm. The structure of the layer can be adapted to the desired resolution by building up columns with a mean cross-section measuring a realistic fraction of the image pixel dimensions on the screen. A realistic fraction lies between about 5 and 20 column diameters per pixel diameter in order to imaging with an acceptable edge resolution. The spacings between the columns measures preferably above about 0.25 μm because for smaller values the optical separation deteriorates and not above about 2 μm because then the stopping power of the layer decreases.

In a preferred embodiment, the angle of incidence, which is to be understood to mean the angle between the direction of the material to be deposited and the central line normal to the screen, lies above approximately 30°. Preferably, the luminescent layer is obtained by vapour deposition, for example, from a crucible to be heated filled with the luminescent material. The homogeneity of the vapour-deposited layer is promoted by rotating the vapour deposition crucible and the support with respect to each other, the vapour deposition crucible preferably describing a circle over a conical surface with respect to the centre of the support. It is then favourable to perform several rotations during the time of vapour deposition of the luminescent layer.

An X-ray image intensifier tube manufactured in accordance with the invention is characterized in that the layer of luminescent material has a column structure, of which the columns have an average transverse dimension of at most about 25 μm and are mutually separated by gaps having an average width lying between about 0.5 μm and a few microns, while at most a small number of columns having a transverse dimension of more than about 50 μm is present and only a small number of gaps having a width considerably larger than a few microns is present. With a view to the spaces between the columns, designated here and below as gaps for the sake of clarity, it should be noted that in this case the type of gaps corresponding to the cracks mentioned according to the prior art is unambiguously meant. The gaps are often rather formed by series of bubbles in the form of mostly elongate bubbles whose longitudinal direction fortunately extends in the direction of the series. Between the bubbles, the columns can contact with each other, but this provides only a comparatively small optical contact. Measured in the longitudinal direction, the bubbles mostly occupy considerably more than 90% of the series length, while also nodes between the bubbles do not form without further expedients a good optical contact; the situation is rather reverse. The vapour deposition at an angle according to the invention shows to have a favourable influence on the bubble formation. Gaps thus obtained represent more or less an intermediate form between the cracks and the separations between, for example, vapour-deposition pillars, which are in principle separate crystals.

A screen structure well adapted to obtain a high resolution can be realized, for example, by vapour deposition according to the invention starting with a substrate temperature of about 20° C. reaching a maximum value not much above about 200° C. to be realized by a well chosen deposition rate and heat transport from the screen.

DETAILED DESCRIPTION OF THE PREFERRED EMBODIMENT

Figure 1:
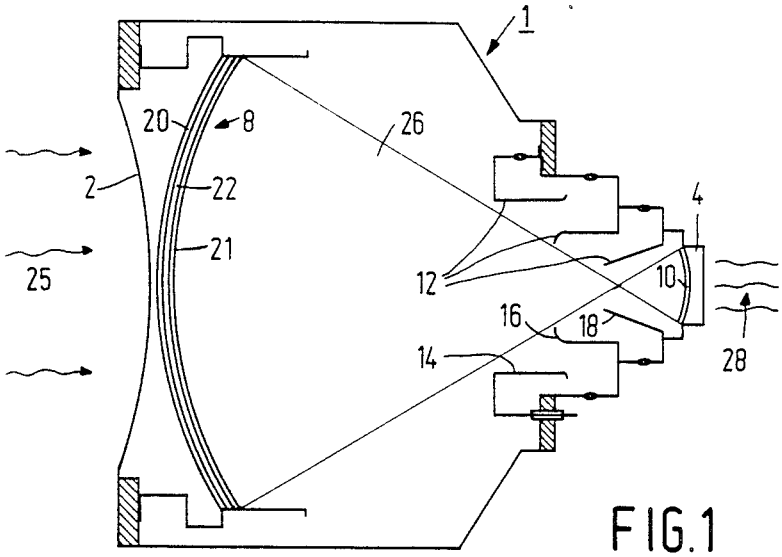
FIG. 1 shows an X-ray image intensifier tube according to the invention.

In FIG. 1, an entrance screen 8, an exit screen 10, an electron-optical system 12 having a first electrode 14, a second electrode 16 and an end electrode 18 are shown of an X-ray intensifier tube according to the invention accommodated in an envelope having an entrance window 2, an exit window 4 and a sheath 6. The entrance screen 8, which in this case is mounted as a separate screen in the tube, but which may also be directly provided on the entrance window, comprises a support or substrate 20 consisting, of an aluminium foil having a thickness of, 0.5 μm, and having a smooth surface on which is provided a luminescent layer 22 preferably consisting of CsI(Na) or CsI(Ti), on which is provided, as the case may be via a separation layer not shown a photocathode 21. An X-ray image 25 incident upon the entrance window is converted in the luminescent layer 22 into a photo-optical image, as a result of which there is produced in the photocathode 21 a photo-electron image 26, which is imaged by the electron-optical system, whilst strongly accelerating the photo-electrons, on the exit screen 10 and is converted into a photo-optical image 28, which can be observed from outside the tube.

For a satisfactory operation and for reduction of the patient dose, it is desirable that the luminescent layer has a comparatively high X-ray absorption. X-rays not trapped by the luminescent screen do not contribute to the image formation, but form a radiation load for the patient. Therefore, the screen will have to be comparatively thick, for example 200 to 400 μm; a thickness of 300 μm certainly traps 75% of the X-ray radiation. In a "normally" vapour-deposited layer of CsI, which is fairly highly transparent, the luminescent light will be strongly spread, especially from the luminescent centres on the incidence side of the layer. This situation is improved by choosing the vapour-deposition conditions so that a structured layer is obtained, for which purpose especially the substrate temperature, more particularly at the beginning of the vapour deposition, is of importance. Photographs taken (preferably by means of a scanning electron microscope) of cross-sections of the layer show that this structure is formed by pillar-shaped crystals, of which a longitudinal direction substantially coincides with the direction of the thickness of the layer. Due to this structure, the spread of the luminescent light is reduced, but to an insufficient extent, because the transitions between the various pillars have an insufficient optical separation. This is due to the fact that the width of the interruptions is insufficient, so on an average considerably smaller than the wavelength of the luminescent light, roughly 0.5 μm. A substantial improvement is obtained if the layer is provided with a crackled structure as described in U.S. Pat. No. 3,821,763. For example by means of an adapted thermal method, each time a number of pillars are joined to form a column without internally distinctly optical separation walls, but having evidently acting optical separation walls between the columns. The fineness of the crackled structure can be influenced considerably by the nature of the thermal treatment and, as the case may be, by providing a structure in the surface of the substrate, for which purpose various methods are known.

Figure 2:
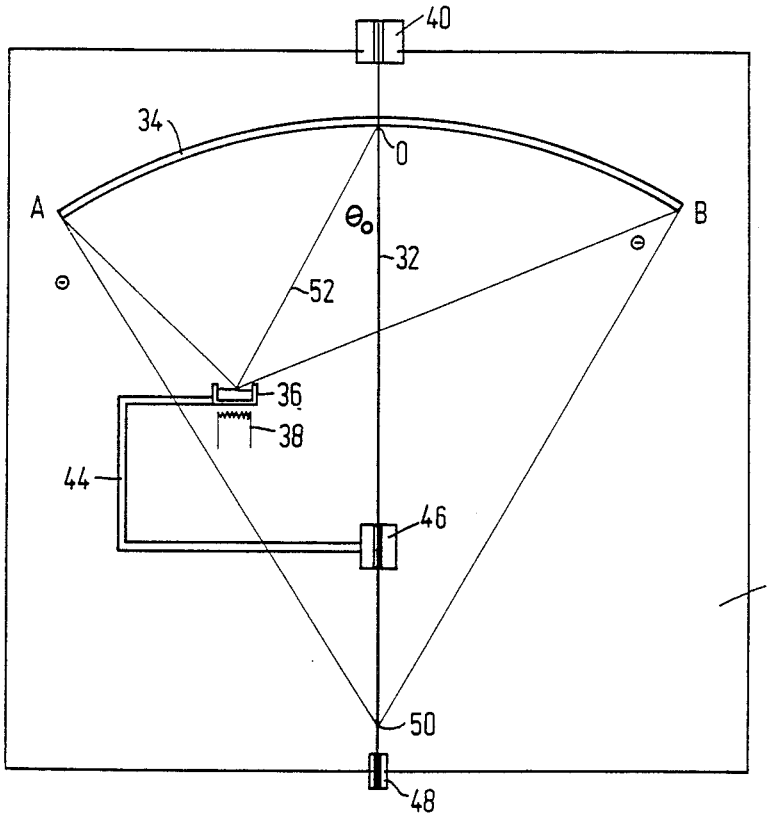
FIG. 2 shows a diagrammatic arrangement for carrying out the method according to the invention, FIGS. 3A(1) to 3A(3) are photographs of a prior art luminescent layer in plan view, and FIGS. 3B(1) to 3B(3) are photographs of the luminescent layer according to the invention in plan view.

During the manufacture of an entrance screen for an X-ray image intensifier tube according to the invention, the starting material may be a not intentionally structured support. FIG. 2 shows very diagrammatically an arrangement for carrying out a vapour-deposition method according to the invention. In a space 30 to be evacuated, a support or substrate 34 and a vapour-deposition crucible 36 containing luminescent material and comprising a heating element 38 are arranged so as to be rotatable in this case about an axis 32. Via a lead-through member 40, the support 34 can be rotated about the axis 32. Also as an alternative, the vapour-deposition crucible 36 can be rotated about the axis 32 via a bracket 44 and a lead-through member 46. The axis 32 preferably coincides with the central line normal to the substrate, which in this case is a sphere segment having a centre 50. For a perpendicular vapour deposition on at least a central point 0 of such a support, the vapour-deposition crucible will be arranged on the line 32, while for a perpendicular vapour deposition over the whole screen the vapour-deposition crucible will have to be arranged in the point 50.

In the vapour-deposition process according to the invention, the vapour-deposition crucible is arranged beside the axis 32. A position of the vapour-deposition crucible 36 as shown results in a vapour-deposition angle $\theta o$, the subscript 0 being used to indicate that this angle applies to the central point 0 of the screen. It is already apparent from the Figure that the angle of incidence varies with the position on the support. Upon rotation of the support 34 about axis 32, vapour deposition takes place over the whole support at a varying angle. However, it should be considered that, properly speaking, except the central point 0, two vapour-deposition angles are concerned, that is to say the inclination, i.e. the angle to a local main line which is constant upon rotation for the central point 0, and an azimuthal angle which also varies for the central point 0 per revolution over 360°.

During vapour deposition of a complete luminescent layer, the support preferably performs a few tens to a few thousands of rotations.

The vapour-deposition crucible can then constantly occupy a fixed position, but the relative movement may also be realized by causing the vapour-deposition crucible to perform by the bracket 44 a circular rotation. A connection line 52 between the vapour-deposition crucible and the point 0 encloses with the central normal line 32 the vapour-deposition angle $\theta o$. As long as the crucible remains positioned on the line 52, a vapour-deposition angle $\theta o$ is concerned, even if the vapour-deposition angles for all the remaining points of the support are varied. A favourable vapour-deposition angle $\theta o$ is about 45, but this also depends upon other vapour-deposition parameters, such as the temperature of the support, the speed of rotation and the speed of vapour deposition.

A preferred value for the substrate temperature is to start from about room temperature and to adapt the deposition rate with a given heat flow from the substrate such that the screen temperature does not go beyond about 200° C. If appropriate the vapour deposition can be realized from more crucibles in sequence. The height of the vapour-deposition crucible, measured, for example, from a plane 54 at right angles to the axis 32 through the central point 50 of the support, is also determinative of the vapour-deposition angles outside the centre of the support and moreover of the local distance between the support and the vapour-deposition crucible. Also with a constant vapour-deposition angle, the thickness variation of the luminescent layer over the screen can thus be influenced. From different points of view, an optimum position of the vapour-deposition crucible with respect to the screen can thus be determined, while in the case of contrasting optimum positions the support can further be tilted with respect to the vapour-deposition crucible during vapour deposition. It may thus be achieved that the distance between the crucible and the edge points A and B of the screen are constantly equal to each other. The vapour-deposition angle $\theta o$ then varies, but it is found that the nominal value for the optimum angle of incidence, provided that it is sufficiently large, is not very exact so that some variation thereof is certainly admissible and may even be favourble. In fact it is not excluded that also the variation of the vapour-deposition angle during vapour deposition is at least partly responsible for the optimization of the structure in the luminescent layer. This supposition is supported by the fact that in spite of the comparatively great difference in vapour-deposition angles measured throughout the screen a luminescent layer is nevertheless obtained having, as far as it is of importance here, a satisfactorily uniform structure.

It will be apparent from the foregoing that different parameters influence the structures of the layer; it is clear that technological marginal conditions also play a part in the vapour deposition. Since the value of the vapour-deposition angle, provided that it is sufficiently large, is not very exact, a satisfactory compromise can nevertheless always be found for different geometries of the support and different requirements with respect to the layer thickness and the variation thereof over the screen. An additional advantage of the application technique acccording to the invention is that the layer as a whole can be applied in a single operation, as a result of which small interruptions in the direction of thickness are also avoided. If the vapour-deposition angle becomes comparatively small, the structure approaches too closely the structure of known screens; if on the contrary the angle becomes comparatively large, the columns of CsI are located far remote from each other and, for example, the filling factor of the screen and hence the X-ray absorption are decreased. Furthermore, in the case of vapour deposition at larger angles, difficulties of more practical nature, such as an inefficient use of the CsI, can be obtained.

For special cases, for example cases in which especially a very high resolution is required, a structure comprising substantially separate columns may be utilized. Optical cross-talk is then completely avoided. The interstices may be filled in principle with a non-luminescent material absorbing X-ray radiation.

In cases in which the geometry does not permit of obtaining an acceptable compromise for the relative positioning etc., for example a solution can be found by flame spraying or plasma spraying of the luminescent material. With a comparatively small nozzle, the support may effectively be scanned (relative movement with respect to each other), while the distance from the support may be chosen freely within wide limits and, for example by tilting the nozzle, any desired angle may be locally adjusted. The procedure may then further be such that a large part of the luminescent material is used effectively. It should be taken into account that in the case of flame or plasma spraying, the remaining conditions, such as the temperature of the support, the rate of deposition, the nature of the material during deposition etc., must not deviate too strongly from the values used during vapour deposition because otherwise a layer having the desired pillar structure may not be obtained.

For comparison, FIGS. 3A(1)–3A(3) show photographs taken by means of a scanning electron microscope of a known structured layer and FIGS. 3B(1)–3B(3) show photographs of a test layer according to the invention, both in plan view, that is to say viewed from a direction remote from the support. The known layer as shown in FIGS. 3A(1)–3A(3) clearly shows (see especially FIG. 3A (1)) comparatively wide cracks 60 and hence, as appears from FIG. 3(A)3 also comparatively large cavities 62. The layer produced in accordance with the invention shown in FIGS. 3B(1)–3B(3) has, as appears from FIG. 3B(1) cracks 64 of only small width and hence, as appears from FIG. 3(B)3, comparatively small cavities 66. By optimization of the whole application technique, cracks having a width exceeding 0.5 to 1 μm apparently can be completely avoided. FIG. 3(B)1 and FIG. 3(B)2 clearly show the extremely regular structure and the comparatively large filling factor due to the absence of wide gaps or cavities, as they occur in the known layers. Due to the improved structure, the layer may be made considerably thicker, for example 400 to 500 μm, without loss of resolution. The regular structure permits of providing on the layer a more continuous photocathode 21 (FIG. 1), with or without the addition of an intermediate layer. As a result, this part of the layer can also be optimized without the coarse structure with wide gaps or cavities thus leading to stringent limitations.

We claim:

1. A method of manufacturing an X-ray image intensifier tube comprising a support having a smooth surface having a layer of luminescent material thereon, said method comprising the following steps:

providing a vapor deposition source of luminescent material facing said smooth surface at an angle above approximately thirty degrees from the central normal to said surface, rotating said support with respect to said source about said central normal to the center of the surface, vapor depositing said luminescent layer on said surface.

2. A method as in claim 1 wherein said vapor deposition source is at an angle between forty and fifty degrees from said central normal.

3. A method as in claim 1 wherein said support performs at least twenty revolutions about said central normal to said surface.

4. A method as in claim 1 wherein said vapor deposition source performs a circular movement about said normal.

5. A method as in claim 4 wherein said vapor deposition source performs at least twenty revolutions about said normal.

6. A method as in claim 1 wherein said support is a sphere segment.

* * * * *